US011998145B2

(12) United States Patent
Johnson et al.

(10) Patent No.: US 11,998,145 B2
(45) Date of Patent: Jun. 4, 2024

(54) DEVICE FOR PORTABLE TOILET PROTECTION

(71) Applicant: Portoseal, LLC, Reno, NV (US)

(72) Inventors: Ronald Leon Johnson, Morgan Hill, CA (US); Paul Andrew Rogers, Folsom, CA (US)

(73) Assignee: Portoseal, LLC, Reno, NV (US)

( * ) Notice: Subject to any disclaimer, the term of this patent is extended or adjusted under 35 U.S.C. 154(b) by 31 days.

(21) Appl. No.: 17/687,355

(22) Filed: Mar. 4, 2022

(65) Prior Publication Data

US 2023/0277019 A1 Sep. 7, 2023

(51) Int. Cl.
*A47K 13/26* (2006.01)

(52) U.S. Cl.
CPC ..... *A47K 13/26* (2013.01)

(58) Field of Classification Search
CPC ..... E03D 11/16–11/17; E03D 9/00; A47K 13/242
USPC ..... 4/485, 253, 252.4–252.5, 287, 295
See application file for complete search history.

(56) References Cited

U.S. PATENT DOCUMENTS 2,529,587 A * 11/1950 Bates ..... E03D 11/00 4/253
5,044,403 A * 9/1991 Chen ..... F16L 55/132 220/236
5,348,085 A * 9/1994 Benson ..... B09C 1/00 166/92.1
8,042,576 B2 * 10/2011 Peterson ..... F16L 55/105 138/93
8,695,653 B2 * 4/2014 Bennett ..... E03D 9/00 4/901
2004/0006816 A1 * 1/2004 Jones ..... E03D 11/00 4/295
2007/0250997 A1 * 11/2007 McDonald ..... A47K 13/242 4/253
2009/0049591 A1 * 2/2009 Orona, Jr. ..... A47K 13/24 4/253
2017/0079486 A1 * 3/2017 Miller ..... A47K 13/242

OTHER PUBLICATIONS

Notification of Transmittal of the International Search Report and the Written Opinion of the International Searching Authority, dated Apr. 3, 2023 for International Application No. PCT/US2023/013860, 8 pages.

* cited by examiner

*Primary Examiner* — Christine J Skubinna
(74) *Attorney, Agent, or Firm* — Haverstock & Owens, A Law Corporation

(57) ABSTRACT

A toilet protection device prevents the human waste contents of a portable toilet from spilling/splashing onto the toilet and/or the walls/floor of the portable toilet enclosure. The toilet protection device includes an expandable rubber seal enabling the toilet protection device to fit in most, if not all, portable toilets regardless of shape or size. Moreover, by using a disposable cover, there is minimal cleanup of toilet protection device.

17 Claims, 8 Drawing Sheets

DEVICE FOR PORTABLE TOILET PROTECTION

FIELD OF THE INVENTION

The present invention relates to the field of sanitation. More specifically, the present invention relates to portable toilets.

BACKGROUND OF THE INVENTION

Portable toilets have been used at construction sites, concerts and other events for many years. Portable toilets generally include a toilet surrounded by a privacy enclosure with a storage tank below for receiving and storing human waste. An issue with portable toilets is that when the toilets are transported, the human waste in the storage tank shifts and splashes around and tends to make a mess inside the privacy enclosure.

SUMMARY OF THE INVENTION

A toilet protection device prevents the human waste contents of a portable toilet from spilling/splashing onto the toilet and/or the walls/floor of the portable toilet enclosure. The toilet protection device includes an expandable rubber seal enabling the toilet protection device to fit in most, if not all, portable toilets regardless of shape or size. Moreover, by using a disposable cover, there is minimal cleanup of toilet protection device.

DETAILED DESCRIPTION OF THE PREFERRED EMBODIMENT

A device for portable toilet protection includes a device body configured to securely fit partially in a toilet bowl to prevent the contents of the storage tank of the toilet from spilling. The toilet protection device is able to be partially or fully covered by a removable, disposable cover for even easier cleanup. The toilet protection device is able to include three or more rests for securing the seat and lid of the toilet to the toilet protection device.

Figure 1A:
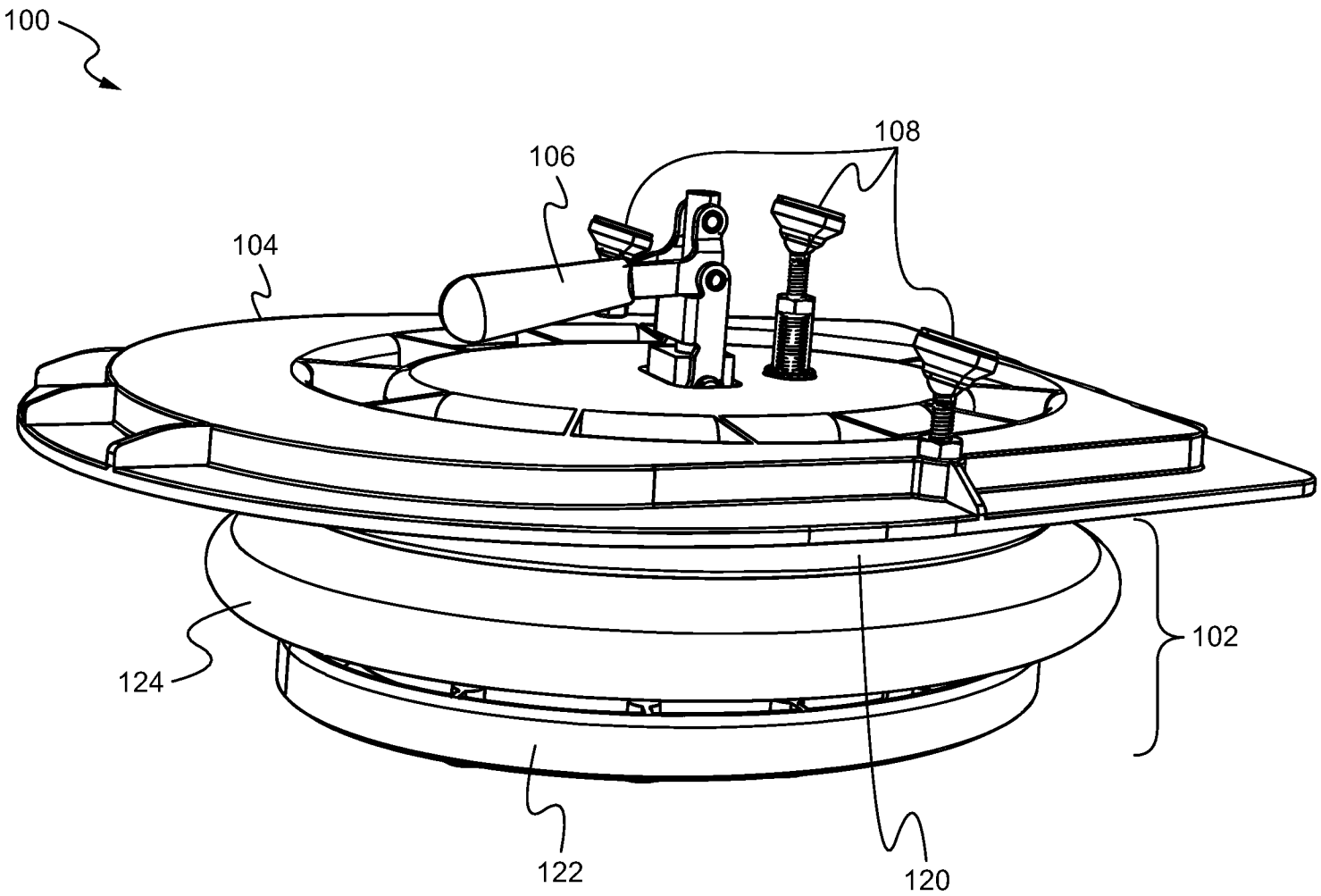
FIG. 1A illustrates a perspective view of the toilet protection device according to some embodiments.

FIG. 1A illustrates a perspective view of the toilet protection device according to some embodiments. The toilet protection device 100 includes a plug 102, a lid 104, a lever 106, and a plurality of rests 108.

The plug 102 includes a first plate 120 and a second plate 122 (or other components) with a rubber seal 124 (or other material such as silicone or another material) in between the first plate 120 and the second plate 122, where the two plates 120, 122 are able to be pushed together which compresses the rubber seal 124 causing the rubber seal 124 to expand out from the plates 120, 122 to form a secure seal with the toilet bowl. The plug 102 is able to be generally round, oval or any other shape to fit securely within a toilet bowl to prevent the contents of the bowl and/or storage (e.g., the human waste and toilet material) from spilling out of the toilet.

In some embodiments, the plug 102 is able to be configured and shaped similar to a drain plug such that the diameter of the plug 102 gradually increases from the bottom to the top of the plug 102. In some embodiments, the plug 102 is a simpler implementation shaped to generally fit in most toilets (e.g., a larger top which gradually narrows to the bottom) without extra components (e.g., plates and rubber seal) such that it fits securely in most toilet bowls.

The lid 104 is configured to sit on top of the toilet bowl to further ensure that the contents within the bowl/storage do not spill out of the toilet. The lid 104 is shaped to fit on top of and cover the toilet bowl. The lid 104 is coupled to the plug 102, in particular, the first plate 120. The lid 104 is shaped and sized to cover the opening of the toilet bowl, possibly having some of the lid 104 extending beyond the toilet bowl.

The lever 106 or other implementation causes two plates or other structures within the plug 102 to compress a rubber seal 124 between the plates 120, 122 causing the rubber seal 124 to expand beyond the plates 120, 122 to form a seal with the toilet bowl. In some embodiments, the compression occurs by the lever 106 pushing the first plate 120 downward against the rubber seal 124 which pushes downward against the second plate 122 which is immovable because it is pushing downward against the toilet bowl. In some embodiments, the compression occurs by the lever 106 pulling the second plate 122 upward against the rubber seal 124 which pushes upward against the first plate 120 which is stationary or configured to push downward. The pressure of the first plate 120 and the second plate 122 pushing against each other causes the flexible, expandable rubber seal 124 to expand out beyond the edges of the plates 120, 122 and form a seal against the toilet bowl. The expandable rubber seal 124 enables the toilet protection device 100 to be secure in many different sizes and shapes of toilet bowls.

In some embodiments, an upper retainer attaches the rubber seal 124 to the first plate 120. In some embodiments, the retainers are around each of the plates 120, 122. In some embodiments, the second plate 122 is attached to a center core/stem which is coupled to the lever 106 which is what is used to compress the rubber seal 124. In some embodiments, a button is utilized instead of a lever with a mechanized implementation. For example, a user pushes a button on top of the toilet protection device 100 which causes a motor within the toilet protection device 100 to compress the plates 120, 122 or another mechanism to cause the rubber seal 124 to expand to form a seal with the toilet bowl. The mechanized implementation is able to be battery powered, solar powered or any other implementation.

In some embodiments, the lever 106 pushes down the plug 102 into the toilet bowl to block the contents of the bowl/storage from escaping the tank/storage. The lever 106 is partially affixed to the lid 104 and couples to the plug 102. By toggling the lever 106 (e.g., lifting or lowering depending on the implementation), an arm of the lever pushes the plug 102 down into the toilet bowl. In some embodiments, the lever 106 is configured to lock in place, use friction or some other implementation to prevent the plug 102 from lifting up from the down position. In some embodiments, a different mechanism is used to position and/or secure the plug 102 in the toilet bowl. For example, an implementation similar to a ¼ turn valve or a screw-like implementation is utilized.

The plurality of rests 108 are configured to receive the toilet seat and lid. For example, the toilet seat and lid rest on top of the plurality of rests 108. In some embodiments, the toilet seat and lid are able to be secured in place against the rests 108 with a rope, bungee cord or some other securing implementation. Each of the plurality of rests 108 is individually adjustable. For example, the height of each rest 108 is able to be adjusted by turning the rest 108 similar to a screw, where clockwise rotation increases the height, and counter-clockwise decreases the height. In some embodiments, the heads of each rest 108 are able to move/rotate slightly such that the angle of each head changes to be able to be positioned flush against the toilet seat or lid.

In some embodiments, the toilet protection device 100 includes additional elements. For example, in some embodiments, the lever 106 or other part of the toilet protection device 100 includes a locking mechanism or an aperture for receiving a locking mechanism (e.g., pad lock) which prevents removal of the toilet protection device 100 from the toilet by maintaining the friction fit of the seal 124 and preventing release of the lever 106. In some embodiments, the toilet protection device 100 includes an aperture or another implementation for enabling the toilet protection device 100 to be securely stored within the portable toilet enclosure to prevent theft. Each component of the toilet protection device 100 is able to be made out of any appropriate material such as plastic, rubber, metal, wood and/or any other material.

Figure 1B:
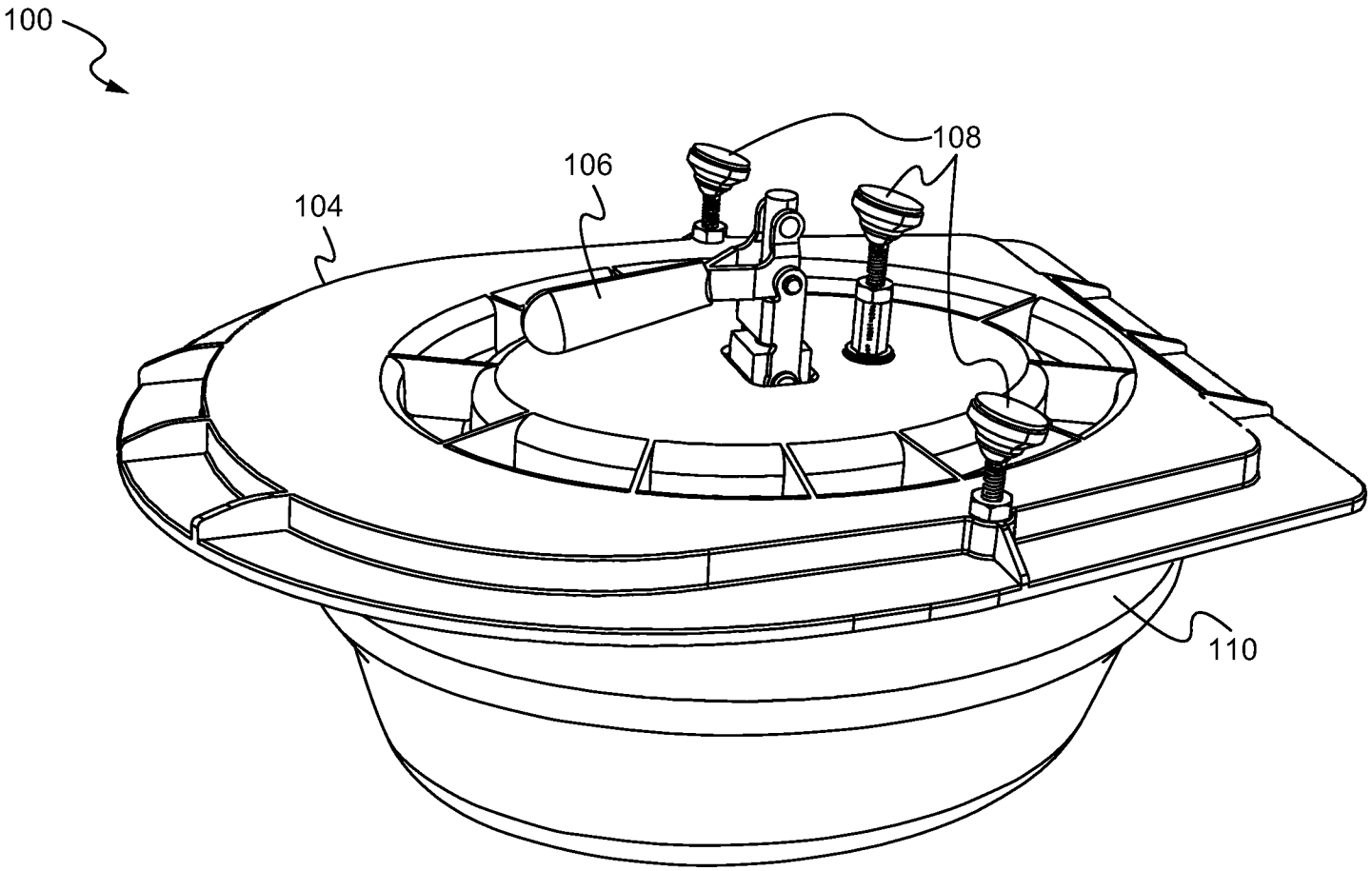
FIG. 1B illustrates a perspective view of the toilet protection device with a cover according to some embodiments.

FIG. 1B illustrates a perspective view of the toilet protection device with a cover according to some embodiments. The toilet protection device 100 includes a plug 102 (FIG. 1A), a lid 104, a lever 106, a plurality of rests 108 and a cover 110.

In some embodiments, a cover 110 is able to be used to cover the plug 102 and/or other parts of the toilet protection device 100 including the entirety of the toilet protection device 100. The cover 110 is able to be a removable, disposable cover such as a bag. The cover 110 enables use of the toilet protection device 100 without having to clean the toilet protection device 100 after each use, or the amount of cleaning of the toilet protection device 100 is reduced. For example, any contents that would splash up and hit the toilet protection device 100 will actually hit the cover 110, so after transport, the cover 110 is able to be removed and thrown out. The cover 110 is able to be secured around the plug 102 with a securing component such as a rubber band, rope, or any other implementation.

Figure 2:
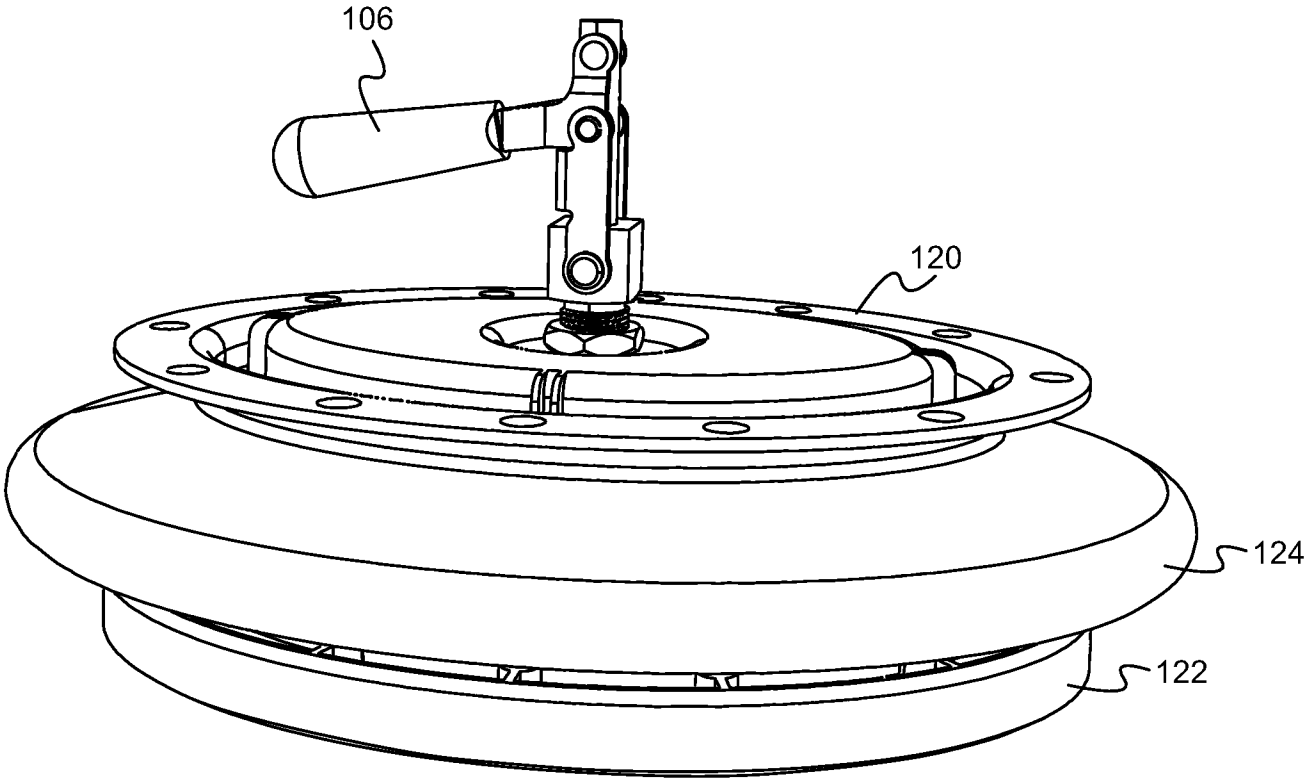
FIG. 2 illustrates an internal view of the plug according to some embodiments.

FIG. 2 illustrates an internal view of the plug according to some embodiments. The plug 102 (FIG. 1A) includes a first plate 120 and a second plate 122 with a rubber seal 124 in between. In some embodiments, the lever 106 has a stem which pushes down on the first plate 120 which pushes down on the rubber seal 124 against the second plate 122. In some embodiments, the lever 106 has a stem which pulls up on the second plate 122 which pushes up on the rubber seal 124 against the first plate 120. In some embodiments, another configuration is used to cause the plug 102 (FIG. 1) to securely fit in a toilet bowl to form a watertight seal.

Figure 3:
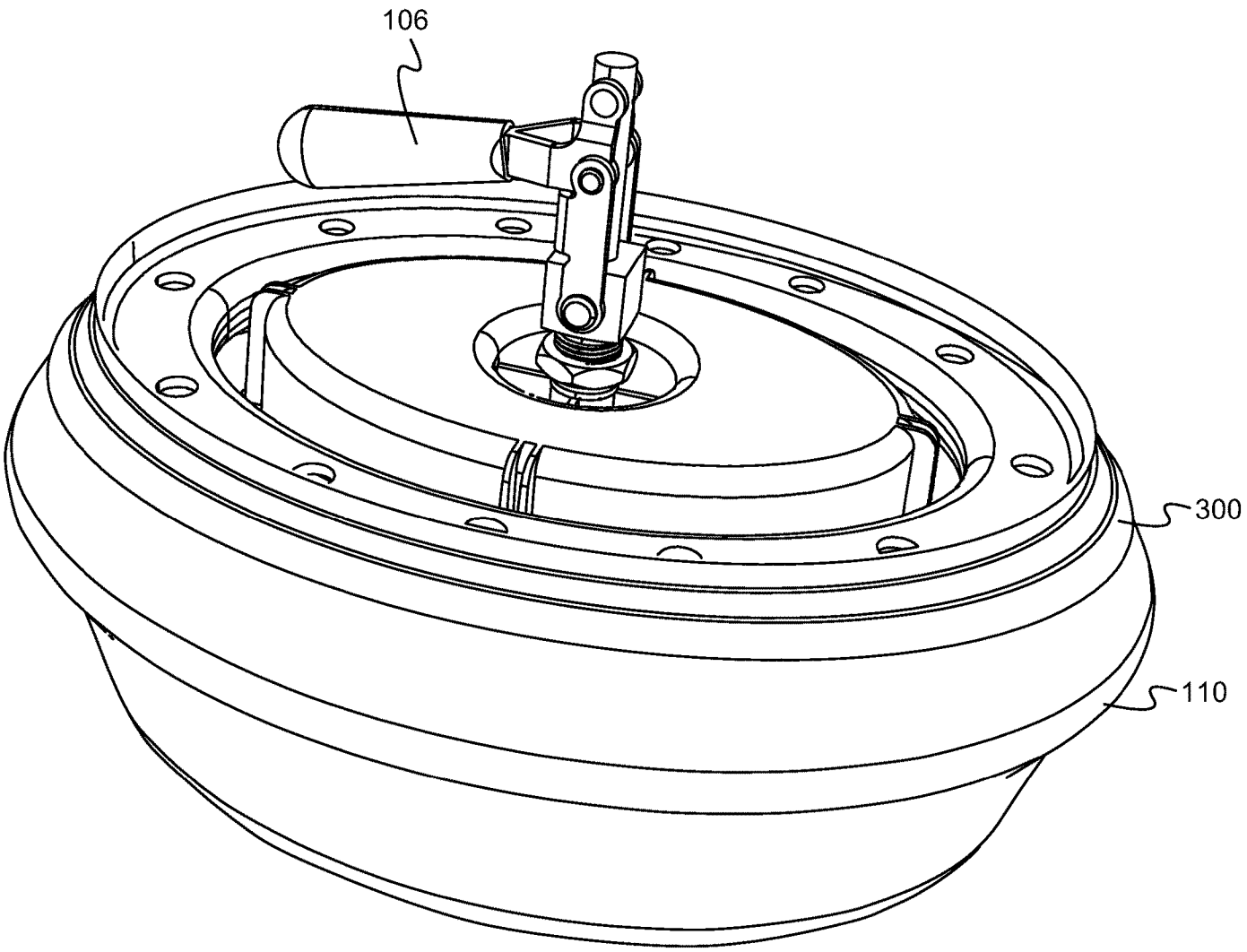
FIG. 3 illustrates an internal view of the plug with a cover according to some embodiments.

FIG. 3 illustrates an internal view of the plug with a cover according to some embodiments. The plug 102 (FIG. 1) includes a cover 110 which is secured in place with a securing mechanism 300 such as a rubber band, rope or another implementation.

Figure 4:
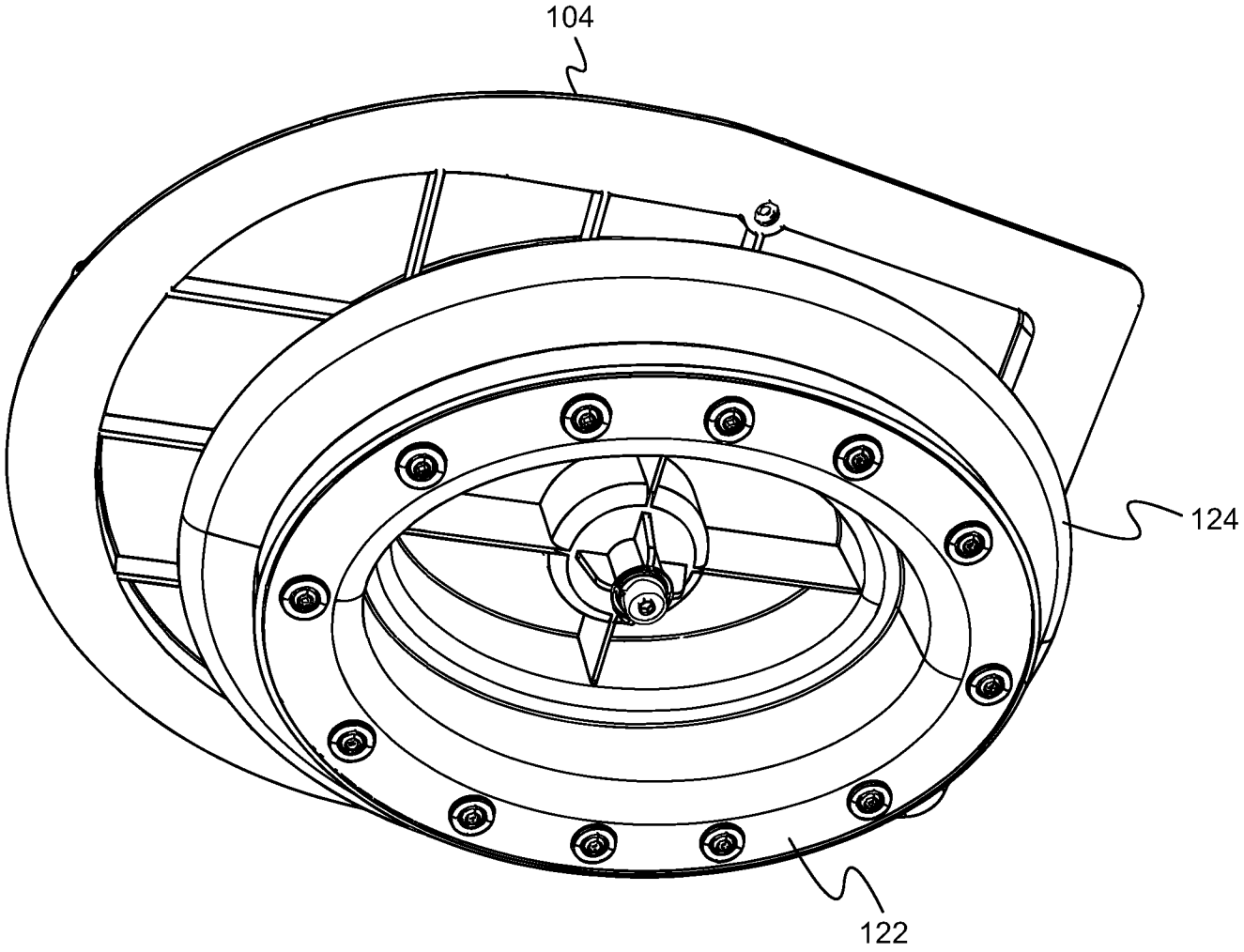
FIG. 4 illustrates a bottom view of the toilet protection device according to some embodiments.

FIG. 4 illustrates a bottom view of the toilet protection device according to some embodiments. Under the lid 104 is the first plate 120 (FIG. 1A), the seal 124 and the second plate 122. The second plate 122 is coupled to the lever 106 (FIG. 1A) in any manner (e.g., a screw, nut/bolt). In some embodiments, the first plate 120 (FIG. 1A), the seal 124 and/or the second plate 122 are secured together (e.g., via screws, nuts/bolts). In some embodiments, the seal 124 is secured to one of the first plate 120 or the second plate 122. In some embodiments, the seal 124 includes a ring of rubber with a hollow/open center, and the first plate 120 and the second plate 122 are shaped such that their outer rims compress the seal 124.

Figure 5:
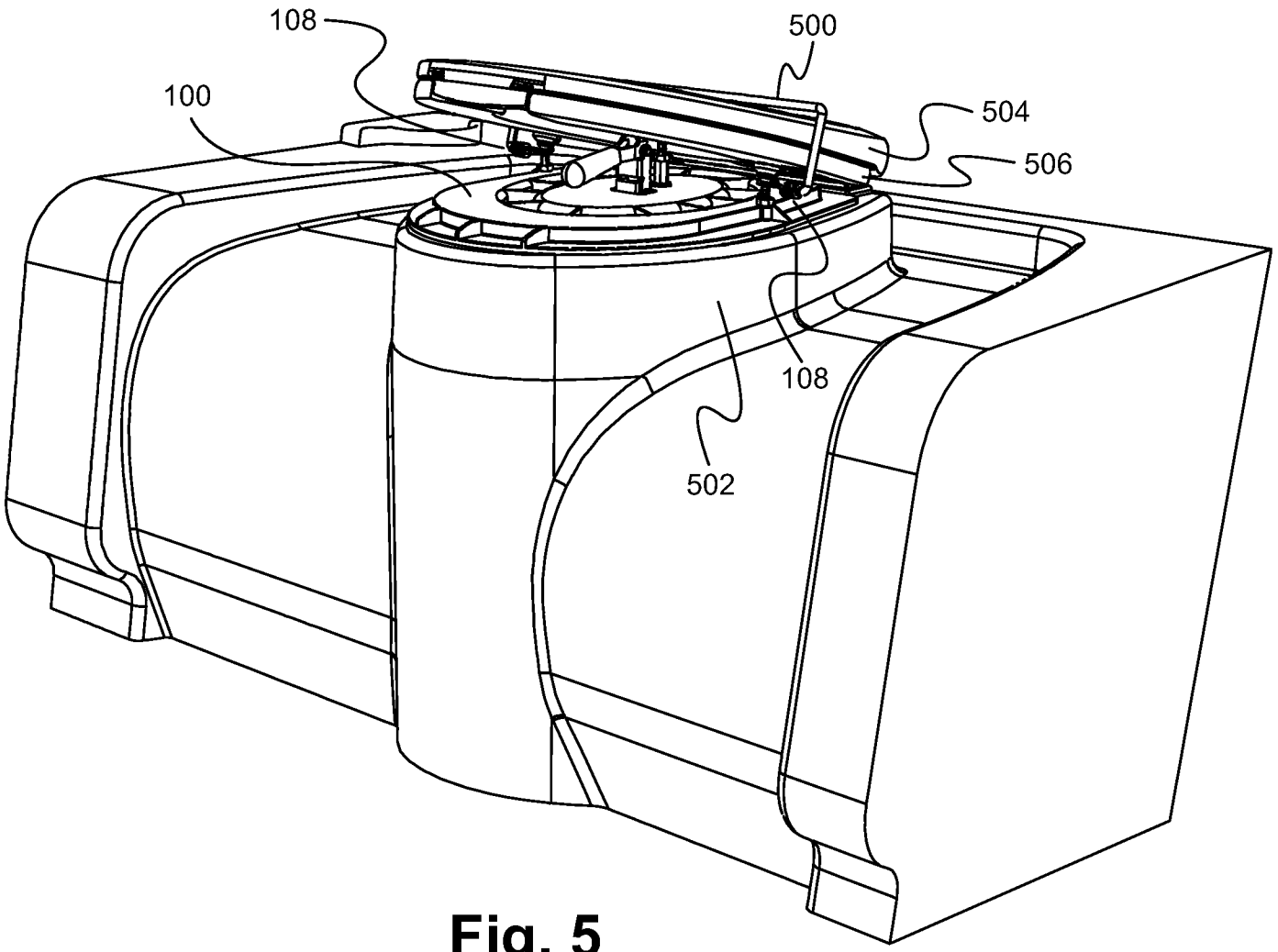
FIG. 5 illustrates a close up view of a toilet protection device securely positioned within a portable toilet according to some embodiments.

FIG. 5 illustrates a close up view of a toilet protection device securely positioned within a portable toilet according to some embodiments. The toilet protection device 100 is positioned within the toilet bowl 502. The toilet seat 506 and the toilet lid 504 are positioned on the rests 108. A securing device 500 such as a bungee cord is able to be used to ensure the toilet seat 506 and toilet lid 504 remain in contact with the rests 108 by coupling to one rest 108 going over the seat and/or lid and coupling to a second rest 108. The securing device 500 also prevents the toilet seat 506 and toilet lid 504 from flopping around and possibly breaking.

Figure 6:
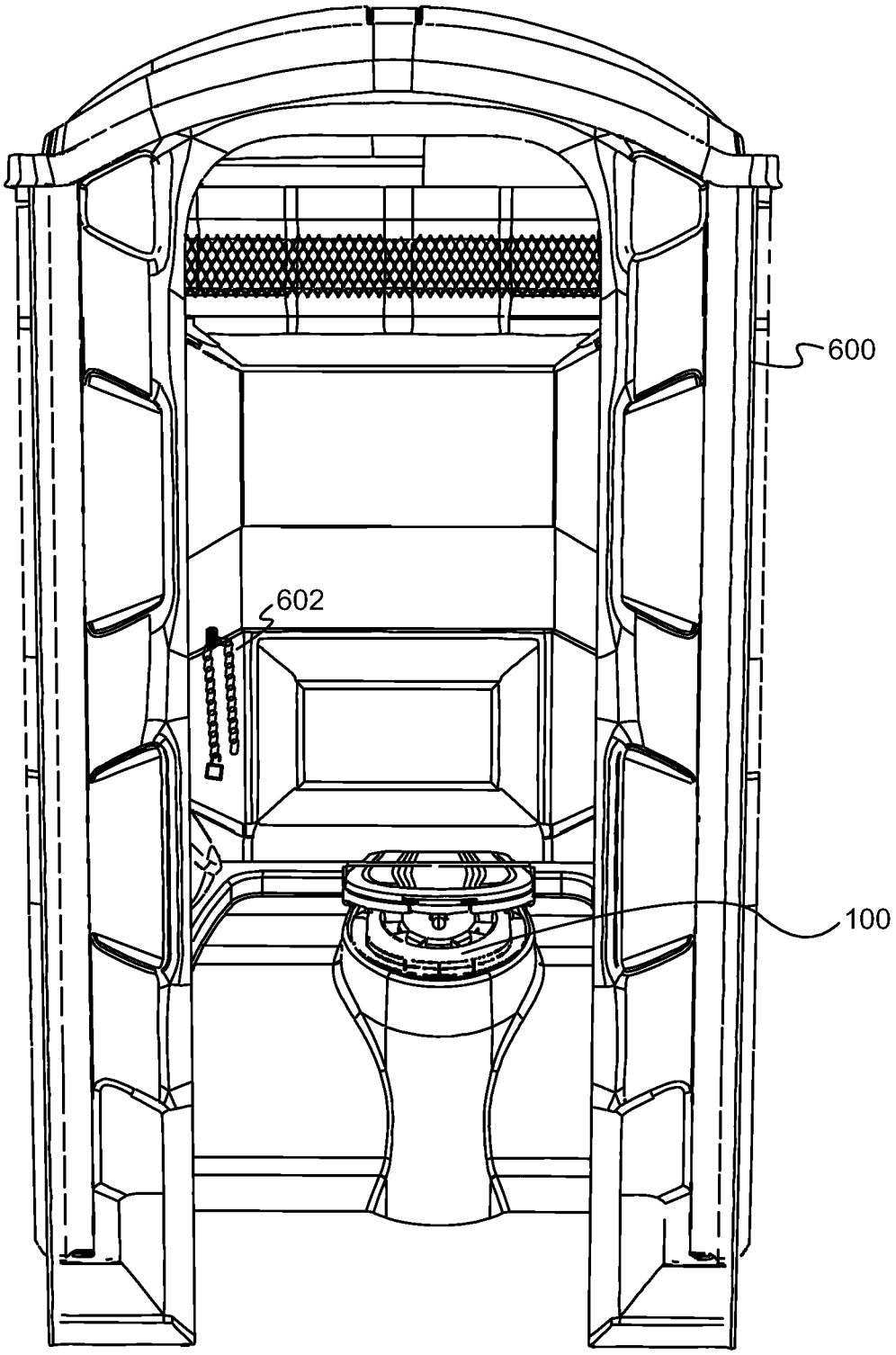
FIG. 6 illustrates a perspective view of a portable toilet with the toilet protection device according to some embodiments.

FIG. 6 illustrates a perspective view of a portable toilet with the toilet protection device according to some embodiments. A portable toilet enclosure 600 typically includes a privacy enclosure and the toilet which is able to receive the toilet protection device 100. To be able to see within the portable toilet enclosure, the door is not shown in the Figure. In some embodiments, a securing device 602 is able to be coupled to a wall or other part of the enclosure to secure/store the toilet protection device 100 while not being used to protect the toilet. For example, the securing device 602 is a chain with a lock where the chain fits in/through/around the toilet protection device 100 to prevent theft of the toilet protection device 100.

Figure 7:
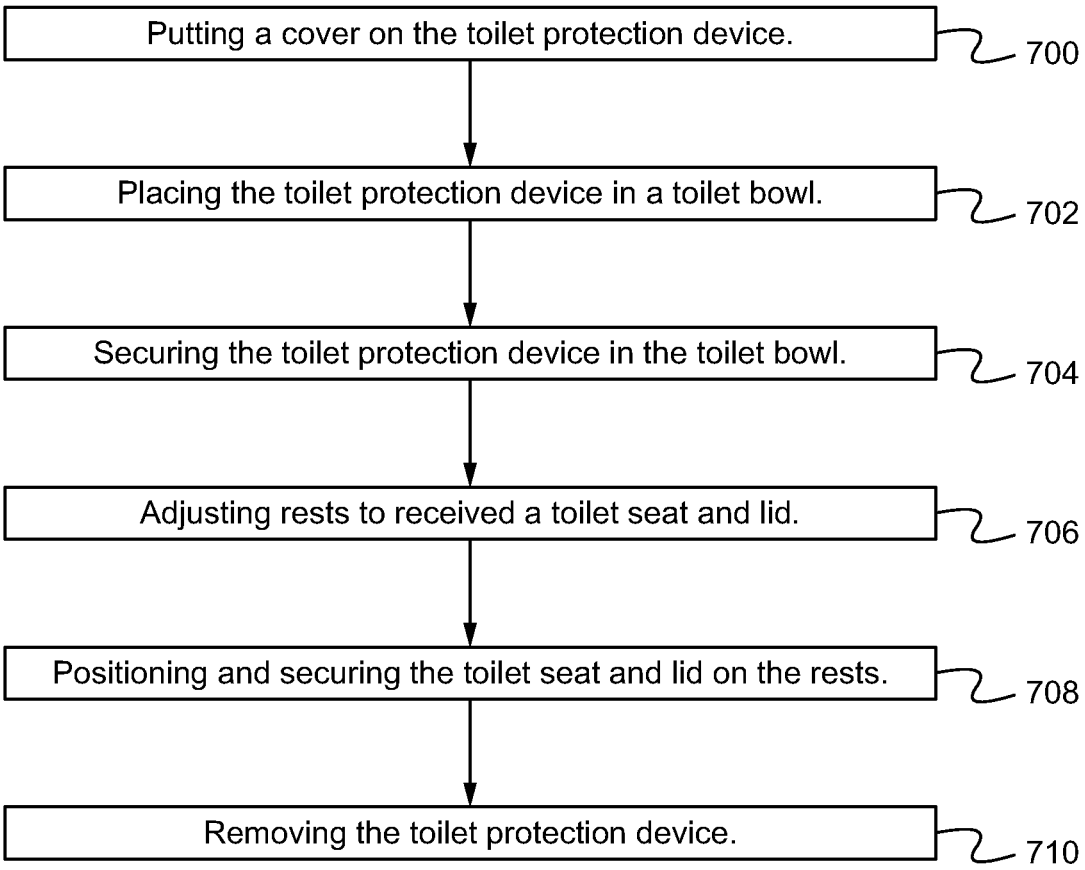
FIG. 7 illustrates a flowchart of a method of utilizing the toilet protection device according to some embodiments.

FIG. 7 illustrates a flowchart of a method of utilizing the toilet protection device according to some embodiments. In the step 700, a user puts a cover on the toilet protection device. For example, a plastic bag is tied around the whole toilet protection device, or a plastic sleeve covers the plug portion of the toilet protection device. In the step 702, a user places the toilet protection device in an open toilet bowl (e.g., the user opens the lid and seat first). In the step 704, the user secures the toilet protection device within the toilet bowl by toggling the lever, for example, by pressing down or lifting the lever (depending on the implementation) until the rubber forms a secure seal with the toilet bowl. In the step 706, the rests are adjusted to receive the toilet seat and lid. In the step 708, the toilet seat and lid are positioned on the rests and secured in place with a bungee cord or other securing mechanism by coupling to one rest, going over the top of the toilet seat/lid and coupling to another rest. The portable toilet is then able to be transported without worry that the contents of the storage tank will spill or splash out. Once in a new location, the toilet protection device is able to be removed by reversing the steps including removing the bungee cord, lifting the lid/seat, toggling the lever, pulling out the toilet protection device, and removing the cover to be thrown out, in the step 710. In some embodiments, fewer or additional steps are implemented. In some embodiments, the order of the steps is modified.

To utilize the toilet protection device, the toilet protection device is positioned in a toilet bowl. Before placing the toilet protection device in the toilet bowl, part or all of the device is able to be covered with a removable cover such as a bag. The toilet protection device is secured within the toilet by pushing a lever or another mechanism which causes two plates to compress a rubber seal which presses against the internal walls of the toilet bowl and is secured by friction. The toilet seat and lid are secured against rests of the toilet protection device using a securing implementation such as a bungee cord. After transporting the portable toilet, the toilet protection device is able to be removed by reversing the process including removing the securing implementation, lifting the lever to reduce the friction of the rubber seal with the toilet bowl and lift out the toilet protection device. The cover of the toilet protection device is able to be removed and discarded appropriately, and the toilet protection device is able to be reused with little to no additional cleanup of the device.

In operation, the toilet protection device prevents the human waste contents of the portable toilet from spilling/splashing onto the toilet and/or the walls of the portable toilet enclosure. Since the toilet protection device includes an expandable rubber seal, the toilet protection device is able to fit in most, if not all, portable toilets regardless of shape or size. Moreover, by using a disposable cover, there is minimal cleanup of toilet protection device.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A device for preventing contents of a storage tank from spilling into a portable toilet enclosure comprising:

a. a plug comprising an expandable seal positioned between a plurality of plates;

b. a lid coupled to the plug;

c. a lever configured for compressing the plurality of plates together causing the expandable structure to expand out beyond the edges of the plurality of plates; and d. a plurality of rests coupled to the lid configured for receiving a toilet seat and a toilet lid.

2. The device of claim 1 further comprising a securing mechanism configured for securing the toilet seat and the toilet lid to the plurality of rests.

3. The device of claim 1 wherein the plurality of rests are configured to adjust in height and angle.

4. The device of claim 1 further comprising a cover configured for covering the plug.

5. The device of claim 4 wherein the cover comprises a removable cover.

6. The device of claim 1 wherein the expandable seal comprises rubber.

7. A method of utilizing a toilet protection device to prevent contents of a storage tank from spilling into a portable toilet enclosure comprising:

a. positioning the toilet protection device in a toilet bowl;

b. securing the toilet protection device within the toilet bowl;

c. adjusting a plurality of rests to receive a toilet seat and a toilet lid; and d. securing the toilet seat and toilet lid to the plurality of rests with a securing mechanism.

8. The method of claim 7 further comprising covering the toilet protection device with a cover.

9. The method of claim 7 wherein securing the toilet protection device within the open toilet bowl includes toggling a lever to cause a rubber mechanism to securely fit within the toilet bowl.

10. The method of claim 9 further comprising releasing the toilet protection device by toggling the lever to release the friction fit of the rubber mechanism.

11. The method of claim 10 further comprising releasing the toilet protection device by removing a securing mechanism from a plurality of rests on the toilet protection device.

12. A device for preventing contents of a storage tank from spilling into a portable toilet enclosure comprising:

a. a plugging component comprising an expandable structure positioned between a plurality of compression components;

b. a triggering component configured for triggering the plurality of compression components to compress together causing the expandable structure to expand out beyond the edges of the plurality of compression components;

c. a lid; and d. a plurality of rests coupled to the lid configured for receiving a toilet seat and a toilet lid.

13. The device of claim 12 further comprising a securing component configured for securing the toilet seat and the toilet lid to the plurality of rests.

14. The device of claim 12 wherein the plurality of rests are configured to adjust in height and angle.

15. The device of claim 12 further comprising a cover configured for covering the plugging component.

16. The device of claim 15 wherein the cover comprises a removable cover.

17. The device of claim 12 wherein the expandable structure comprises rubber.

* * * * *